US011600251B2

(12) United States Patent
Yamagiwa et al.

(10) Patent No.: US 11,600,251 B2
(45) Date of Patent: Mar. 7, 2023

(54) MUSICALITY INFORMATION PROVISION METHOD, MUSICALITY INFORMATION PROVISION APPARATUS, AND MUSICALITY INFORMATION PROVISION SYSTEM

(71) Applicants: University of Tsukuba, Ibaraki (JP); Osaka University, Osaka (JP); Roland Corporation, Shizuoka (JP)

(72) Inventors: Shinichi Yamagiwa, Ibaraki (JP); Yoshinobu Kawahara, Osaka (JP); Hidemasa Togai, Shizuoka (JP); Yoshiyasu Kitagawa, Shizuoka (JP); Ikuo Tanaka, Shizuoka (JP); Tomoko Nakai, Shizuoka (JP)

(73) Assignees: UNIVERSITY OF TSUKUBA, Ibaraki (JP); OSAKA UNIVERSITY, Osaka (JP); ROLAND CORPORATION, Shizuoka (JP)

( * ) Notice: Subject to any disclaimer, the term of this patent is extended or adjusted under 35 U.S.C. 154(b) by 131 days.

(21) Appl. No.: 17/078,621

(22) Filed: Oct. 23, 2020

(65) Prior Publication Data

US 2021/0043172 A1 Feb. 11, 2021

Related U.S. Application Data

(63) Continuation of application No. PCT/JP2019/016635, filed on Apr. 18, 2019.

(30) Foreign Application Priority Data

Apr. 26, 2018 (JP) ..... JP2018-084816

(51) Int. Cl.
*G10H 1/06* (2006.01)
*G10G 1/00* (2006.01)

(52) U.S. Cl.
CPC ..... *G10G 1/00* (2013.01); *G10H 1/06* (2013.01)

(58) Field of Classification Search
CPC ..... G10H 1/0025; G10H 2220/101; G10H 2240/145; G10H 2210/111;
(Continued)

(56) References Cited

U.S. PATENT DOCUMENTS

2001/0039870 A1 11/2001 Shimaya et al.
2008/0257133 A1* 10/2008 Sasaki ..... G10H 1/0025 84/604
(Continued)

FOREIGN PATENT DOCUMENTS

JP 2001-242863 9/2001
JP 2004-272130 9/2004
(Continued)

OTHER PUBLICATIONS

Machine Translation of JP2015-4973 downloaded from Google Patents on Oct. 13, 2020; 9 pages.
(Continued)

*Primary Examiner* — Marlon T Fletcher
(74) *Attorney, Agent, or Firm* — K&L Gates LLP

(57) ABSTRACT

A musicality information provision method includes acquiring first performance data from a performance of a given composition, calculating, with respect to a combination of a plurality of parameters indicating musicality, which are included in the first performance data, respective distances between the first performance data and a plurality of sets of second performance data that are acquired from performances of the given composition and that are compared with the first performance data, and outputting determination information for determining the musicality of the first per-
(Continued)

formance data, the determination information including information indicating the distances.

10 Claims, 13 Drawing Sheets

(58) Field of Classification Search
CPC ..... G10H 2240/056; G10H 2210/066; G10H 2210/151; G10H 2240/131; G10H 2210/105; G10H 1/0066; G10H 2210/341; G10H 2210/076; G10H 2210/081; G10H 1/40; G10H 2240/141; G10H 2210/091; G10H 2210/031; G10H 2210/061; G10H 2210/051; G10H 2210/561; G10H 3/125; G10H 1/02; G10H 2210/555; G10H 1/00
See application file for complete search history.

(56) References Cited

U.S. PATENT DOCUMENTS

| | | | | |
|---|---|---|---|---|
| 2014/0020546 | A1 | 1/2014 | Sumi | |
| 2016/0104469 | A1* | 4/2016 | Takahashi | G09B 15/00 84/609 |
| 2018/0240448 | A1* | 8/2018 | Nariyama | G10H 1/366 |

FOREIGN PATENT DOCUMENTS

| | | | | |
|---|---|---|---|---|
| JP | 2013-182045 | | 9/2013 | |
| JP | 2013-182045 | | 12/2013 | |
| JP | 2014-038308 | | 2/2014 | |
| JP | 2015-4973 | | 1/2015 | |
| JP | 2016-161900 | | 9/2016 | |
| JP | 2017-083484 | | 5/2017 | |
| WO | WO-2016009444 | A2 * | 1/2016 | G10H 1/366 |
| WO | WO-2018016581 | A1 * | 1/2018 | G10G 1/00 |

OTHER PUBLICATIONS

Machine Translation of JP2013-182045 downloaded from Google Patents on Oct. 13, 2020; 12 pages.
Author unknown; International Search Report of PCT/JP2019/016635; dated Jun. 11, 2019; 2 pgs.
Machine Translation of JP2004-272130 downloaded from Espacenet on Jan. 20, 2021; 15 pages.
Machine Translation of JP2016-161900 downloaded from Espacenet on Jan. 20, 2021; 21 pages.
Okumura et al.; Statistical modeling of performers considering musical score-comparative analysis of individuality and performance tendency; Proceedings of Spring Meeting Acoustical Society of Japan 2011; Mar. 11, 2011; pp. 1081-1082.
Okumura et al.; A study of comparative analysis of music performances based on the statistical model that associates expression and notation; IPSJ Technical Report, Music Information Science; No. 45; pp. 1-6; vol. 2015-MUS-107.
Nakamura; International Preliminary Report on Patentability of PCT/JP2019/016635; dated Oct. 27, 2020; 9 pgs.
Machine Translation of JP2001-242863A downloaded from Google Patents on May 21, 2021; 20 pages.
Machine Translation of JP2014-038308A downloaded from Google Patents on May 7, 2021; 18 pages.
Machine Translation of JP2017-083484A downloaded from Google Patents on May 7, 2021; 12 pages.

* cited by examiner

| | d(1) | d(2) | d(3) | d(4) | d(5) |
|---|---|---|---|---|---|
| d(1) | 0 | 0.08 | 0.15 | 0.25 | 0.1 |
| d(2) | 0.08 | 0 | 0.4 | 0.2 | 0.2 |
| d(3) | 0.15 | 0.4 | 0 | 0.5 | 0.1 |
| d(4) | 0..25 | 0.2 | 0.5 | 0 | 0.2 |
| d(5) | 0.1 | 0.2 | 0.1 | 0.2 | 0 |

FIG. 12A

RANKING INFORMATION

| PLAYER | PERFORMANCE ID NUMBER | |
|---|---|---|
| Ana | 1496711068578320 | |
| COMPOSITION NAME | AS IN A MORNING SUNRISE | |
| | | |
| PLAYER | PERFORMANCE ID NUMBER | DISTANCE |
| Ana | 1496711096365040 | 137 |
| Betty | 1498536476519180 | 353 |
| Betty | 1498536531899760 | 355 |
| Carol | 1496711152230360 | 365 |
| Danielle | 1496710494180530 | 386 |
| Erika | 1497853870543270 | 395 |
| Betty | 1498536500830870 | 442 |
| Florence | 1496711196929350 | 458 |
| Grace | 1496711038757720 | 481 |
| Carol | 1496711123666880 | 520 |
| Erika | 1497853903628020 | 539 |
| Hilary | 1496710685736340 | 577 |
| Isabel | 1498538714354720 | 577 |
| Grace | 1496711001472880 | 589 |
| Florence | 1496711252231670 | 591 |
| Florence | 1496711223725640 | 625 |
| Florence | 1496711281224670 | 627 |
| Florence | 1496711305943080 | 649 |

FIG. 12B

RANKING INFORMATION (CONTINUATION)

| | | |
|---|---|---|
| Jeanette | 1496710293413440 | 674 |
| Jeanette | 1496710247846640 | 739 |
| Jeanette | 1496710322466450 | 745 |
| Zara | 1496710526999810 | 754 |
| Jeanette | 1496710349358100 | 769 |
| Jeanette | 1496710373324450 | 776 |
| Kate | 1496710571285730 | 846 |
| Laura | 1496710935524190 | 869 |
| Margaret | 1496710717534740 | 888 |
| Laura | 1496710972679050 | 902 |
| Kate | 1496710650992930 | 908 |
| Kate | 1496710605721440 | 912 |

FIG. 15

| TEST No. | CLASS |
|---|---|
| 1 | 1 |
| 2 | 2 |
| 3 | 1 |
| 4 | 5 |
| 5 | 5 |

DISTANCE MATRIX $$\begin{bmatrix} 0 & 1 & 0 & 4 & 4 \\ 1 & 0 & 1 & 3 & 3 \\ 0 & 1 & 0 & 4 & 4 \\ 4 & 3 & 4 & 0 & 0 \\ 4 & 3 & 4 & 0 & 0 \end{bmatrix}$$

FIG. 16

| TEST No. | CLASS |
|---|---|
| 1 | 1 |
| 2 | 2 |
| 3 | 1 |
| 4 | 5 |
| 5 | 5 |
| *6* | *3.3* |

ADD TO LIST

DISTANCE MATRIX $$\begin{bmatrix} 0 & 1 & 0 & 4 & 4 & 2.3 \\ 1 & 0 & 1 & 3 & 3 & 1.3 \\ 0 & 1 & 0 & 4 & 4 & 2.3 \\ 4 & 3 & 4 & 0 & 0 & 1.7 \\ 4 & 3 & 4 & 0 & 0 & 1.7 \\ 2.3 & 1.3 & 2.3 & 1.7 & 1.7 & 0 \end{bmatrix}$$

GENERATE RANKING FROM THESE VALUES

MUSICALITY INFORMATION PROVISION METHOD, MUSICALITY INFORMATION PROVISION APPARATUS, AND MUSICALITY INFORMATION PROVISION SYSTEM

CROSS-REFERENCE TO RELATED APPLICATION

This application is a continuation application of International Application PCT/JP2019/016635 filed on Apr. 18, 2019 and designated the U.S., and this application is based upon and claims the benefit of priority of the prior Japanese Patent Application No. 2018-084816, filed on Apr. 26, 2018, the entire contents of which are incorporated herein by reference.

BACKGROUND OF THE INVENTION

1. Field of the Invention

The present disclosure relates to a musicality information provision method, a musicality information provision apparatus, and a musicality information provision system.

2. Description of the Related Art

Conventionally, in order to evaluate skill of an individual, there is a device evaluating a performance by comparing performance data generated by a user with musical composition data (musical piece data) used for evaluation (for example, Japanese Patent Application Publication No. 2004-272130 and Japanese Patent Application Publication No. 2001-242863). There also is a device determining the similarity between the performance data and the composition data for the purpose of evaluating and retrieving with respect to a performance (for example, Japanese Patent Application Publication No. 2014-38308, Japanese Patent Application Publication No. 2017-83484, Japanese Patent Application Publication No. 2016-161900, and Japanese Patent Application Publication No. 2015-4973)

SUMMARY OF THE INVENTION

Contents of a performance of a musical composition differs according to a musicality of an individual performer, such as the individual's interpretation of the composition, his/her approach to (way of thinking about) music, the object of the performance, and so on. Musicality is determined and classified in a comprehensive fashion using performance elements such as articulation, sense of rhythm, phrasing, and dynamics, for example.

In the related art described above, the performance skill of an individual is evaluated or retrieved simply by comparing comparison-target performance data with reference data and determining the similarity thereof to the reference data. Hence, in the related art, classifying the musicality of a plurality of sets of performance data is not considered.

An object of an embodiment of the present invention is to provide a musicality information provision method, a musicality information provision apparatus, and a musicality information provision system enabling the provision of information that may be used to determine and classify musicality.

An aspect of an embodiment of the present invention is a musicality information provision method including acquiring first performance data from a performance of a given composition, calculating, with respect to a combination of a plurality of parameters indicating musicality, which are included in the first performance data, respective distances between the first performance data and a plurality of sets of second performance data that are acquired from performances of the given composition and that are compared with the first performance data, and outputting determination information for determining the musicality of the first performance data, the determination information including information indicating the distances.

According to this aspect, the musicality to which the first performance data belongs may be determined intuitively from the information indicating the distances between the first performance data and the plurality of sets of second performance data with respect to the combination of the plurality of parameters indicating the musicality, and the group to which the musicality belongs may be classified. Note, however, that the first and second performance data may also be classified into a plurality of musicality groups using a given classification algorithm such as k-means.

The combination of the plurality of parameters indicating the musicality preferably includes at least time differences between operation start timings of performance controllers during a standard performance of the given composition and the operation start timings of the performance controllers in the first performance data. The parameters that are combined with these time differences may be selected as appropriate from a plurality of selectable parameters. For example, the time differences between the operation start timings of the performance controllers during the standard performance of the given composition and the operation start timings of the performance controllers in the first performance data may be combined with strengths by which the operation controllers are operated in the first performance data and lengths of notes produced by operating the operation controllers in the first performance data. Note, however, that instead of the strengths of the operations and the lengths of the produced notes, differences between the strengths by which the operation controllers are operated in the first performance data and the strengths of the operations during the standard performance, and differences between the lengths of the produced notes in the first performance data and the lengths of the notes produced during the standard performance may be used.

The information indicating the distances includes information indicating a distribution of the first performance data and the plurality of sets of second performance data with respect to the plurality of parameters indicating the musicality. Alternatively, the information indicating the distances includes information indicating sets of second performance data, among the plurality of sets of second performance data, up to a given ranking in ascending or descending order of the distance from the first performance data. The information indicating the distances may also include information indicating respective performers of the first performance data and the second performance data.

The musicality information provision method may further include determining a musicality group to which the performer of the first performance data belongs on the basis of the information indicating the distances, acquiring a plurality of sets of performance data that are different from the first performance data but belong to the determined group, and generating edited performance data by editing the one or more sets of performance data. The edited performance data may be transmitted to a given transmission destination.

Another aspect of the present invention is a musicality information provision apparatus including an acquisition unit for acquiring first performance data from a performance of a given composition, a calculation unit for calculating, with respect to a combination of a plurality of parameters indicating musicality, which are included in the first performance data, respective distances between the first performance data and a plurality of sets of second performance data that are acquired from performances of the given composition and that are compared with the first performance data, and an output unit for outputting determination information for determining the musicality of the first performance data, the determination information including information indicating the distances.

A further aspect of the present invention is a musicality information provision system including a terminal apparatus for transmitting performance data of a given composition performed using an electronic musical instrument, and a server having a reception unit for receiving the performance data as first performance data, a calculation unit for calculating, with respect to a combination of a plurality of parameters indicating musicality, which are included in the first performance data, respective distances between the first performance data and a plurality of sets of second performance data that are acquired from performances of the given composition and that are compared with the first performance data, and an output unit for outputting determination information for determining the musicality of the first performance data, the determination information including information indicating the distances.

A further aspect of the present invention may include a program for causing a computer to operate as a server having the reception unit, the calculation unit, and the output unit, or a recording medium storing the program.

BRIEF DESCRIPTION OF THE DRAWINGS

FIG. 12A and FIG. 12B illustrate an example of ranking information;

FIG. 15 is an illustrative view illustrating generation and updating of the distance matrix; and FIG. 16 is an illustrative view illustrating generation and updating of the distance matrix.

DESCRIPTION OF THE PREFERRED EMBODIMENTS

A musicality information provision system according to embodiments will be described below with reference to the figures.

First Embodiment

Outline of Musicality Classification System

Figure 1:
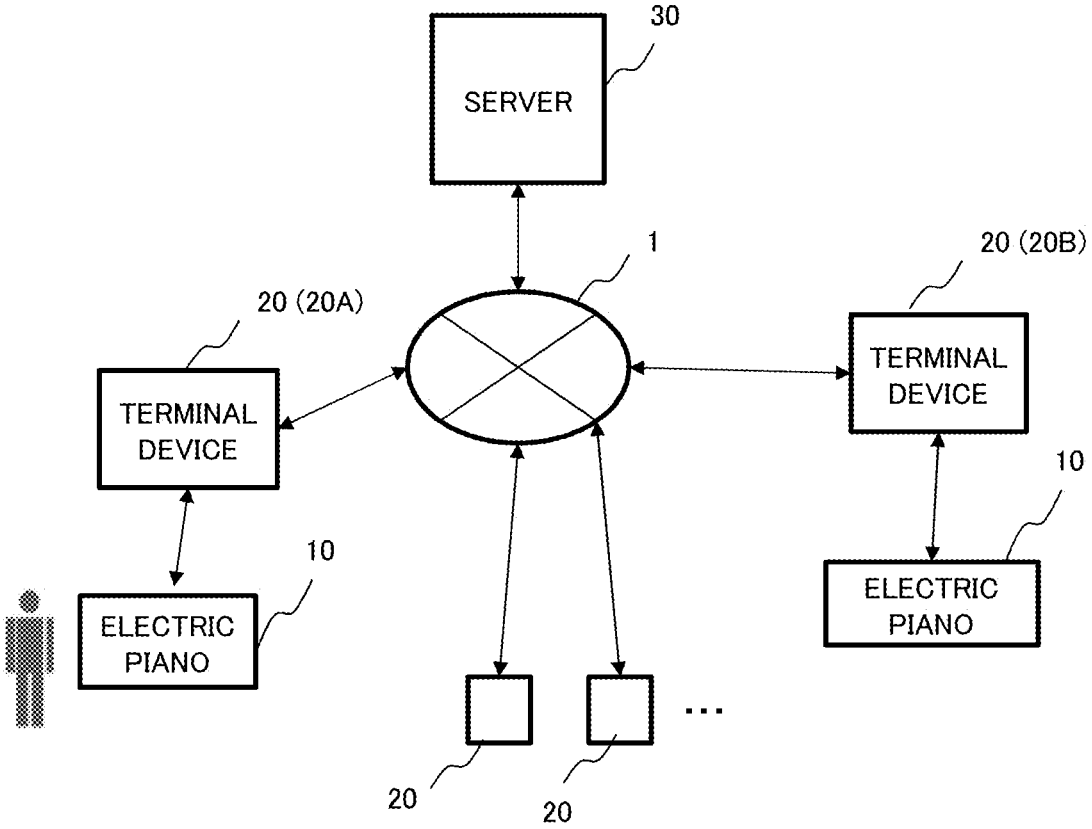
FIG. 1 illustrates an example of a musicality information provision system according to a first embodiment.

FIG. 1 illustrates an example of a musicality information provision system according to a first embodiment. In FIG. 1, the musicality information provision system includes an electronic piano 10, a terminal apparatus 20, and a server 30.

The electronic piano 10 is an example of an electronic musical instrument that may be applied to the musicality information provision system. Applicable electronic musical instruments include various electronic musical instruments imitating keyboard instruments (pianos, organs, synthesizers, and so on), percussion instruments (drums and so on), wind instruments (saxophones and so on), and the like.

The electronic piano 10 is capable of recording a musical composition performed by a performer by musical instrument digital interface (MIDI), and storing the recording as a MIDI file. The electronic piano 10 is capable of short-range wireless communication with the terminal apparatus 20, and may transmit the MIDI file to the terminal apparatus 20.

The terminal apparatus 20 is a mobile apparatus such as a smartphone or a tablet terminal that transmits the MIDI file to the server 30 over a network 1. Note, however, that the terminal apparatus 20 is not limited to a wireless terminal such as a mobile apparatus and may also be a fixed terminal such as a personal computer or a workstation.

The network 1 is a wide-area network such as a LAN or a WAN. A part of the network 1 may include a wireless segment. The wireless segment is constructed using a wireless LAN network such as WiFi or a cellular network such as 3G or LTE, for example.

The server 30 performs processing for outputting musicality information, or in other words information that may be used to determine and classify the musicality of a performance. The server 30 collects and stores MIDI files produced by a plurality of performers in relation to a given composition. The MIDI files include performance data for reproducing the performance, and the performance data include a plurality of parameters relating to the performance. The server 30 calculates distances (similarities) between a plurality of sets of performance data with respect to a combination of a plurality of parameters indicating musicality (referred to hereafter as musicality parameters), among the plurality of parameters included in the performance data, and outputs musicality information including information indicating the calculated distances.

For example, in relation to a certain composition, the server 30 calculates respective distances between comparison target performance data (set as first performance data) and a plurality of sets of performance data (a plurality of sets of second performance data) that differ from the first performance data and are compared with the first performance data. The server 30 outputs information including a ranking table (rankings) on which the second performance data are arranged in ascending or descending order of distance. Alternatively, the server 30 outputs information visualizing the distances between the first performance data and the respective sets of second performance data. By providing this information, the first and second performance data may be intuitively classified into a plurality of musicality groups.

Further, the server 30 stores information indicating the musicality group to which the first performance data belong. In this case, the server 30 extracts composition data belonging to the same group (having the same musicality) as the musicality group to which the first performance data belong from a composition database, and generates a MIDI file of edited composition data acquired by editing the plurality of extracted composition data. Furthermore, the server 30 transmits the MIDI file of the edited composition data to a predetermined destination, for example a predetermined terminal apparatus 20, over the network 1. The terminal apparatus 20 may transmit the edited composition data to a predetermined electronic piano 10 or cause the electronic piano 10 to play the edited composition data automatically. The MIDI file of the edited composition data may also be reproduced on the terminal apparatus 20 using a MIDI playback application (known as a MIDI player).

Configurations of devices and apparatuses constituting the musicality information provision system will be described below.

<Electronic Piano>

Figure 2:
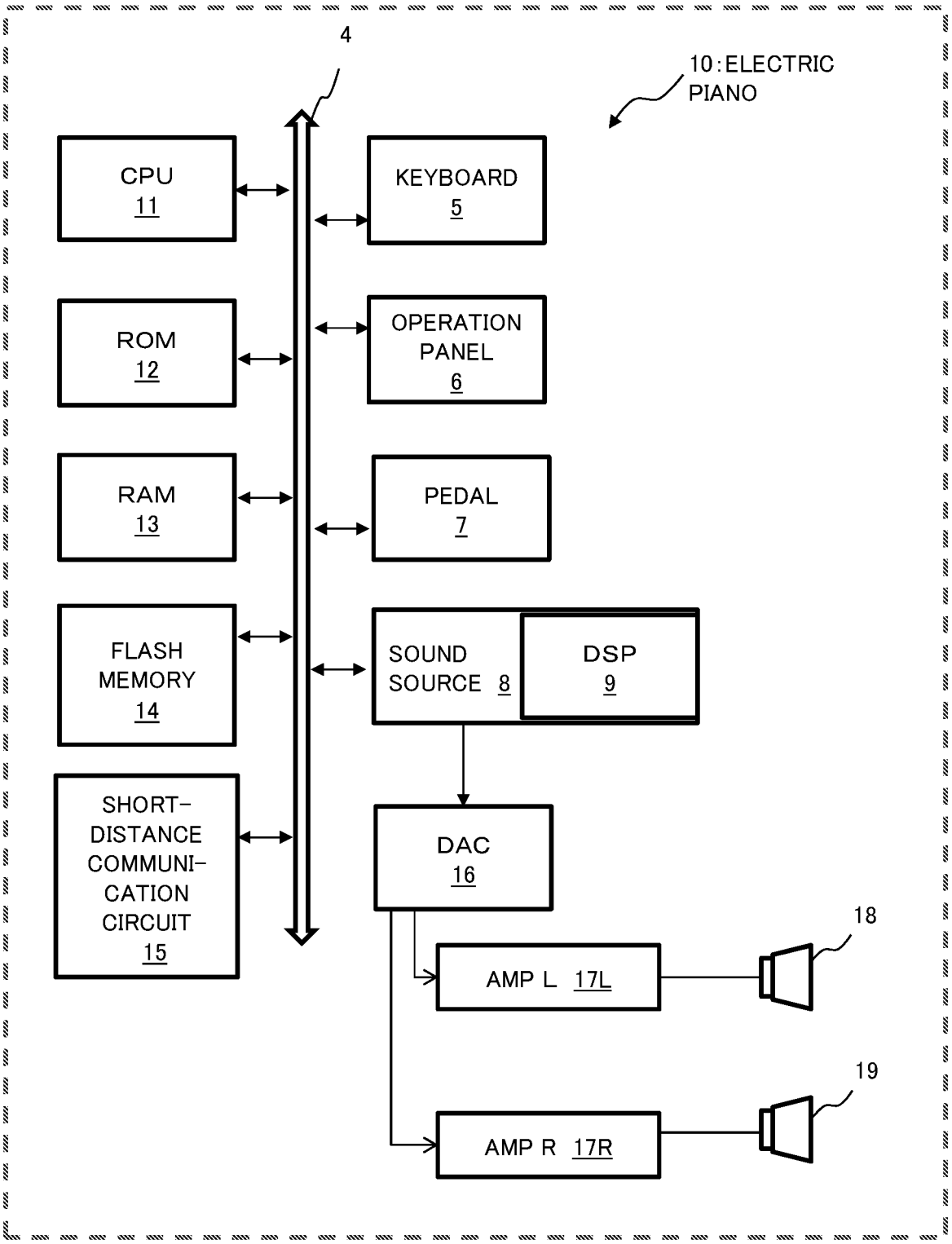
FIG. 2 is a view illustrating an example electrical configuration of an electronic piano.

FIG. 2 is a view illustrating an example electrical configuration of the electronic piano 10. The electronic piano 10 includes a central processing unit (CPU) 11, a read only memory (ROM) 12, a random access memory (RAM) 13, a flash memory 14, a short-range wireless communication circuit 15, a keyboard 5, an operating panel 6, a pedal 7, and a sound source 8, and these components are connected to each other via a bus line 4. The electronic piano 10 also includes a D/A converter (a DAC) 16, amplifiers (AMPs) 17L, 17R, and speakers 18, 19. The sound source 8 is connected to an input of the DAC 16, and an output of the DAC 16 is connected to respective inputs of the amplifiers 17L, 17R. An output of the amplifier 17L is connected to the speaker 18, and an output of the amplifier 17R is connected to the speaker 19.

The CPU 11 is a processor (calculation processing device), and the ROM 12 is a memory for storing various control programs executed by the CPU 11 and fixed value data referenced during execution thereof. The RAM 13 is a rewritable memory for temporarily storing various data and so on during execution of the control programs stored in the ROM 12. The flash memory 14 is a nonvolatile memory that continues to store content even when the power supply of the electronic piano 10 is switched off.

Although not illustrated in the figures, the keyboard 5 includes a plurality of keys (white keys and black keys). The keys are examples of performance controllers. The operating panel 6 includes various volume controllers (e.g., dials), switches and so on, and the performer may use the operating panel 6 to set various operating modes, tone parameters, and the like on the electronic piano 10. The pedal 7 is a device that is operated by being pressed by the foot of the performer. The pedal 7 is provided to acquire acoustic effects produced by operating a soft pedal, a damper pedal, and so on. For ease of description, it is assumed that the pedal 7 includes a single pedal.

The sound source 8 has an inbuilt digital signal processor (DSP) 9, and when a key on the keyboard 5 is pressed, the sound source 8 generates a stereo digital tone signal of a pitch and a timbre corresponding to tone information output from the CPU 11. When a key on the keyboard 5 is released, meanwhile, the sound source 8 stops generating the digital tone signal.

Here, the stereo digital tone signal is a digital tone signal having an L channel (a left channel) and an R channel (a right channel). When a stereo digital tone signal is output from the sound source 8, the DAC 16 converts the stereo digital tone signal into a stereo analog tone signal.

The L-channel analog tone signal output from the DAC 16 is input into the amplifier 17L and amplified. The amplified tone signal is converted into a tone and output from the speaker 18. The tone output from the speaker 18 forms the L channel of a tone corresponding to the pressed key, or in other words a component constituted mainly by a tone in the low range.

Meanwhile, the R-channel analog tone signal output from the DAC 16 is input into the amplifier 17R and amplified. The amplified tone signal is converted into a tone and output from the speaker 19. The tone output from the speaker 19 forms the R channel of a tone corresponding to the pressed key, or in other words a component constituted mainly by a tone in the high range.

The CPU 11 executes MIDI recording of a composition performed by a performer, or in other words performance data (MIDI file) generation processing, by executing a program. Operation statuses of the keyboard 5 and the pedal 7 during the performance of the composition by the performer are included in the performance data as parameter information indicating performance information (the timing, pitch, strength, and so on of the produced notes) created on the basis of the MIDI standard.

The MIDI file (the performance data) includes at least the following parameters.

The type of the pressed key
Note-on
Note-off
Velocity
Hold
Duration

A note-on denotes a timing at which a note starts to be produced, and a note-off denotes a timing at which a note stops being produced. In other words, a note-on indicates a timing at which a key is pressed, and a note-off indicates a timing at which the key is released. The note is output continuously between the note-on and the note-off. Velocity indicates the speed at which the key is pressed. Duration, which is also referred to as the gate time, indicates the number of ticks (the minimum unit of time) between the note-on and the note-off, or in other words the length of the note. Hold expresses, for example, the strength and the timing at which the pedal 7 is pressed. A note-on corresponds to an operation start timing of a performance controller of the musical instrument, while the velocity corresponds to the strength of the operation of the performance controller.

The CPU 11 stores the generated MIDI file in the flash memory 14. The short-range wireless communication circuit 15 is a communication interface for performing wireless communication conforming to a short-range wireless communication standard(s) such as Bluetooth (registered trademark), BLE, or Zigbee. The MIDI file is transmitted to the terminal apparatus 20 by communication using the short-range wireless communication circuit 15.

<Terminal Apparatus>

Figure 3:
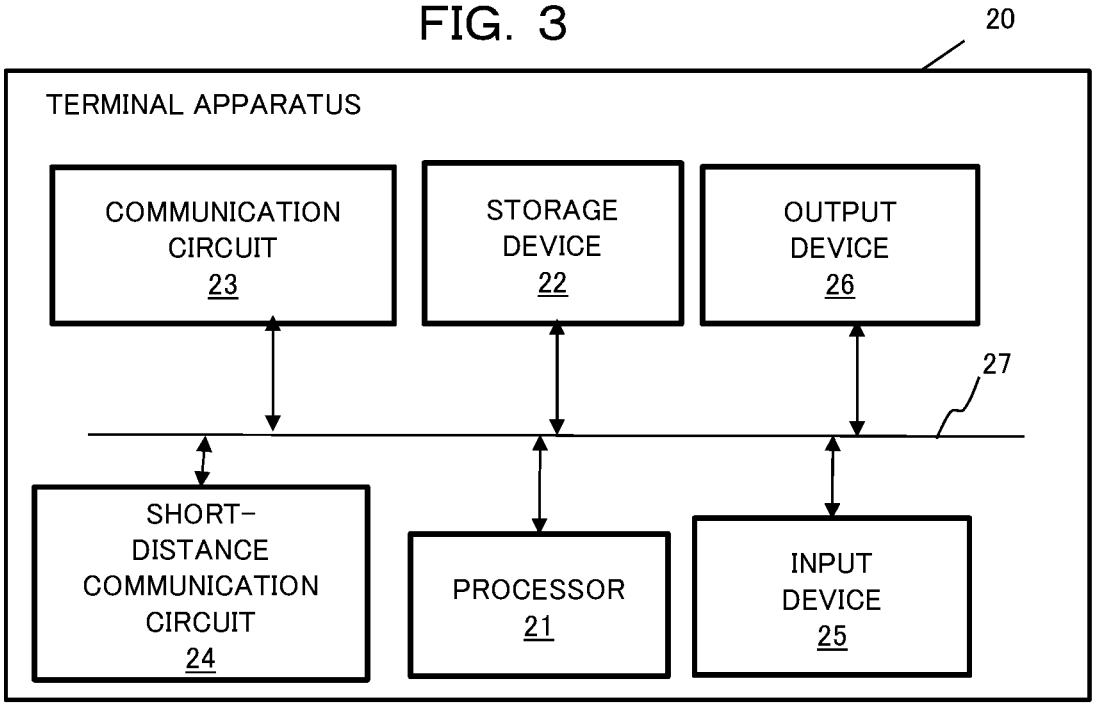
FIG. 3 illustrates an example configuration of a terminal apparatus.

FIG. 3 illustrates an example configuration of the terminal apparatus 20. The terminal apparatus 20 includes a processor 21, a storage device 22, a communication circuit 23, a short-range wireless communication circuit 24, an input device 25, and an output device 26, which are connected to each other via a bus 27.

The storage device 22 includes a main storage device and an auxiliary storage device. The main storage device is used as a storage area for programs and data, a working area for the processor 21, a buffer area for communication data, and so on. The main storage device is constituted by a RAM or a combination of a RAM and a ROM. The auxiliary storage device is used to store data and programs. The auxiliary storage device is a hard disk, a solid state drive (SSD), a flash memory, an EEPROM, or the like.

The communication circuit 23 is a communication interface circuit (a network card) used to communicate with the network 1. The short-range wireless communication circuit 24 is a communication interface circuit for short-range wireless communication, and is used to communication with the electronic piano 10 and so on.

The input device 25 is used to input information. The input device 25 includes keys, buttons, a pointing device, a touch panel, and so on. The output device 26 is used to output information. The output device 26 is a display, for example. Note that the input device 25 may include audio and video input devices (a microphone and a camera). The output device 26 may include an audio output device (a speaker).

The processor 21 includes a CPU and so on, and performs various processing by executing the programs stored in the storage device 22. For example, the processor 21 performs processing for receiving a MIDI file by performing short-range wireless communication with the electronic piano 10 and storing the received MIDI file in the storage device 22, processing for transmitting the MIDI file stored in the storage device 22 to the server 30 over the network 1, and so on.

<Server>

Figure 4:
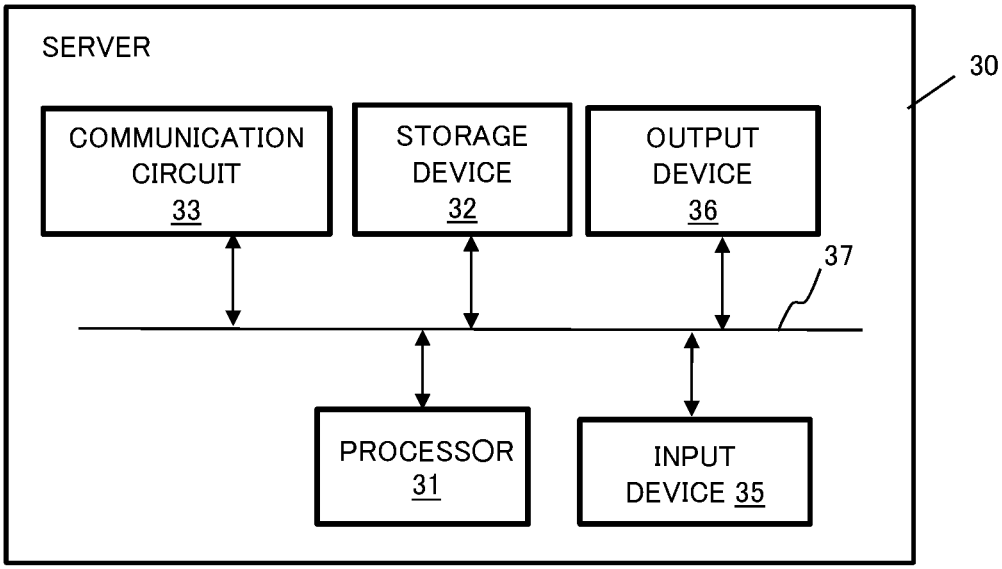
FIG. 4 illustrates an example configuration of a server.

FIG. 4 illustrates an example configuration of the server. The server 30 is formed using a dedicated or general-purpose computer (an information processing apparatus) such as a server machine, a personal computer, or a workstation. The server 30 includes a processor 31, a storage device 32, a communication circuit 33, an input device 35, and an output device 36, which are connected to each other via a bus 37. Similar components to the processor 21, the storage device 22, the communication circuit 23, the input device 25, and the output device 26 may be applied to the processor 31, the storage device 32, the communication circuit 33, the input device 35, and the output device 36. Note, however, that high-performance, high-precision components are applied in accordance with the processing load and the processing scale.

The storage device 32 stores programs executed by the processor 31 and data used during execution of the programs. The processor 31 performs various processing for classifying a plurality of sets of performance data into musicality groups by executing the programs stored in the storage device 32.

For example, the processor 31 performs processing for generating a distance matrix indicating distances (statistical distances) between a plurality of sets of collected performance data (MIDI files) by calculating the distances between the sets of performance data with respect to a combination of a plurality of parameters indicating musicality (musicality parameters), which are included in each set of performance data. Further, when comparison target performance data are input, the processor 31 performs processing (pre-processing) for acquiring the musicality parameters using the performance data and standard performance data. Furthermore, using the distance matrix, the processor 31 performs processing for calculating the respective distances between the comparison target performance data (first performance data) and the plurality of sets of performance data forming the distance matrix (a plurality of sets of second performance data) with respect to the musicality parameters, and outputs information indicating the distance between the first performance data and each set of second performance data, and so on.

The communication circuit 33 operates as an "acquisition unit" and a "reception unit". The processor 31 operates as a "calculation unit". The output device 36 operates as an "output unit". Moreover, the storage device 32 is an example of a storage medium.

Note that a CPU is also known as a microprocessor (MPU) or a processor. The CPU is not limited to a single processor and may have a multiprocessor configuration. Furthermore, a single CPU connected by a single socket may have a multicore configuration. Moreover, at least a part of the processing performed by the CPU may be executed by a multicore CPU or a plurality of CPUs. At least a part of the processing performed by the CPU may be performed by a processor other than CPU, for example a dedicated processor such as a digital signal processor (DSP), a graphics processing unit (GPU), a numerical calculation processor, a vector processor, or an image processing processor.

Further, at least a part of the processing performed by the CPU may be performed by an integrated circuit (an IC or an LSI) or another digital circuit. Moreover, the integrated circuit or the digital circuit may include an analog circuit. The integrated circuit includes an LSI, an application specific integrated circuit (ASIC), and a programmable logic device (PLD). The PLD includes a complex programmable logic device (CPLD) and a field-programmable gate array (FPGA). At least a part of the processing performed by the CPU may be executed by a combination of a processor and an integrated circuit. This combination is known as a microcomputer (MCU), a System-on-a-chip (SoC), a system LSI, a chip set, and so on, for example.

<Processing Executed in Server>

Figure 5:
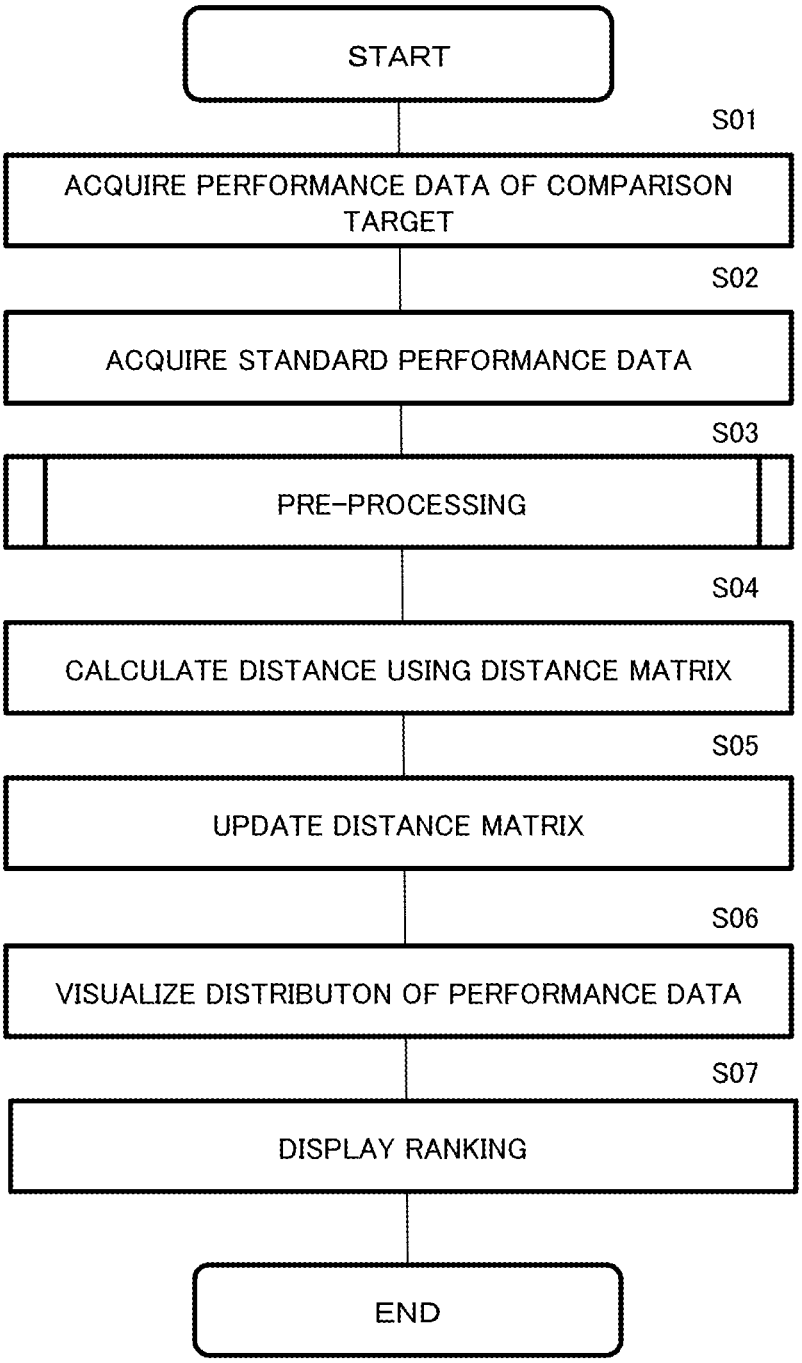
FIG. 5 is a flowchart illustrating an example of processing performed in the server.

FIG. 5 is a flowchart illustrating an example of the processing performed in the server 30. The processing of FIG. 5 is performed by the processor 31 of the server 30. In S01, the processor 31 acquires the comparison target performance data (the first performance data). The comparison target performance data are constituted by a MIDI file acquired by MIDI-recording a performance of a given composition, played by a certain performer (referred to as a first performer) using the electronic piano 10.

As described above, the comparison target performance data are acquired by being received by the server 30 from the terminal apparatus 20 over the network 1. Note, however, that the comparison target performance data may be acquired from a device (apparatus) other than the terminal apparatus 20, for example the storage device 32 in the server 30 or an external storage device, or may be acquired from a device other than the terminal apparatus 20 over the network 1. The processor 31 stores the comparison target performance data in the storage device 32 in association with performance identification information and performer identification information.

In S02, the processor 31 acquires the MIDI file of a standard performance to be compared with the comparison target performance data. For example, the MIDI file of the standard performance is constituted by performance data acquired when the given composition is played as written on the score, for example. The MIDI file of the standard performance may be stored in advance in the storage device 32 or acquired from a predetermined device over the network 1. The processing of S01 and S02 may be performed in reverse order.

In S03, the processor 31 performs processing (referred to as pre-processing) for acquiring the musicality parameters using the MIDI file of the comparison target performance data and the MIDI file of the standard performance.

Figure 6:
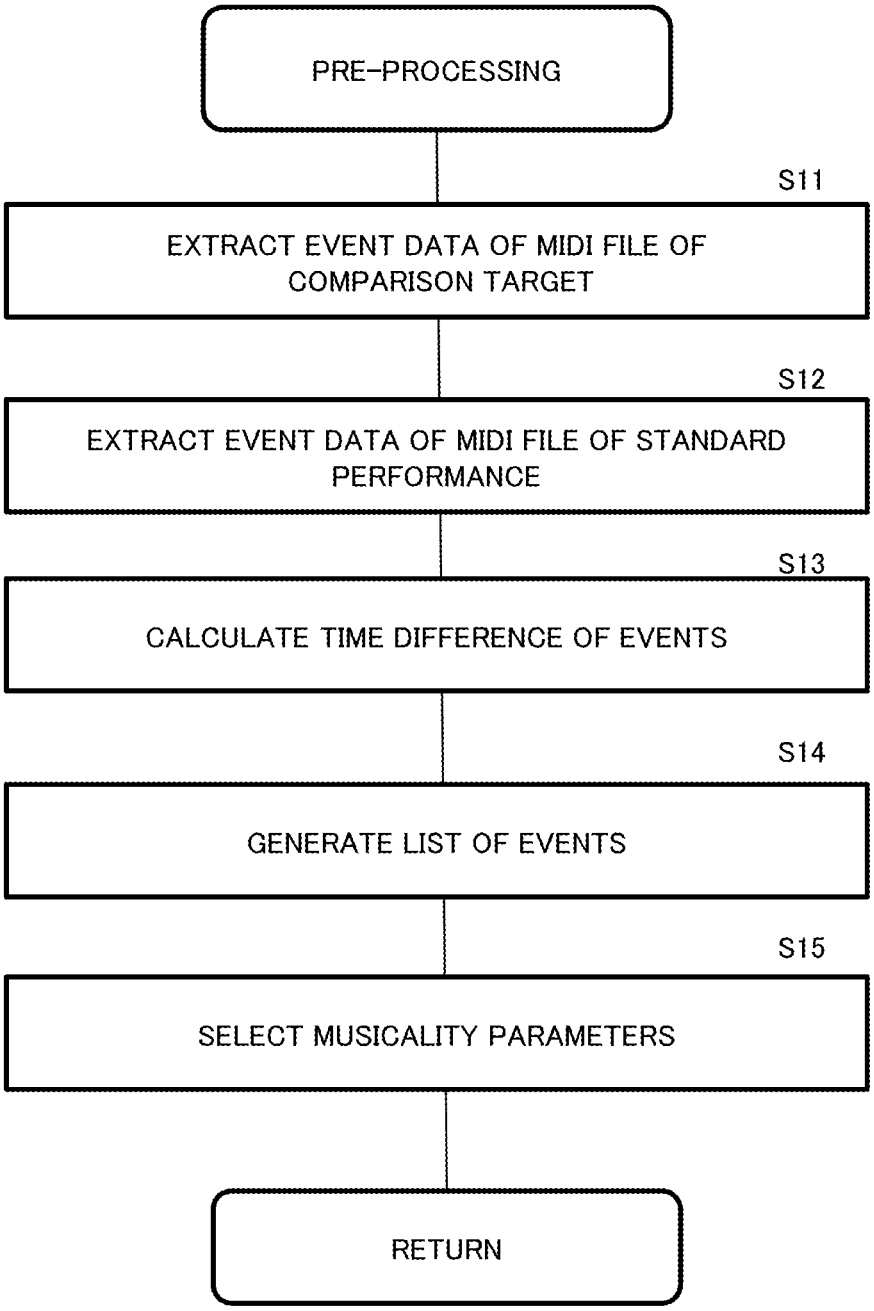
FIG. 6 is a flowchart illustrating an example of preprocessing.
Figure 7:
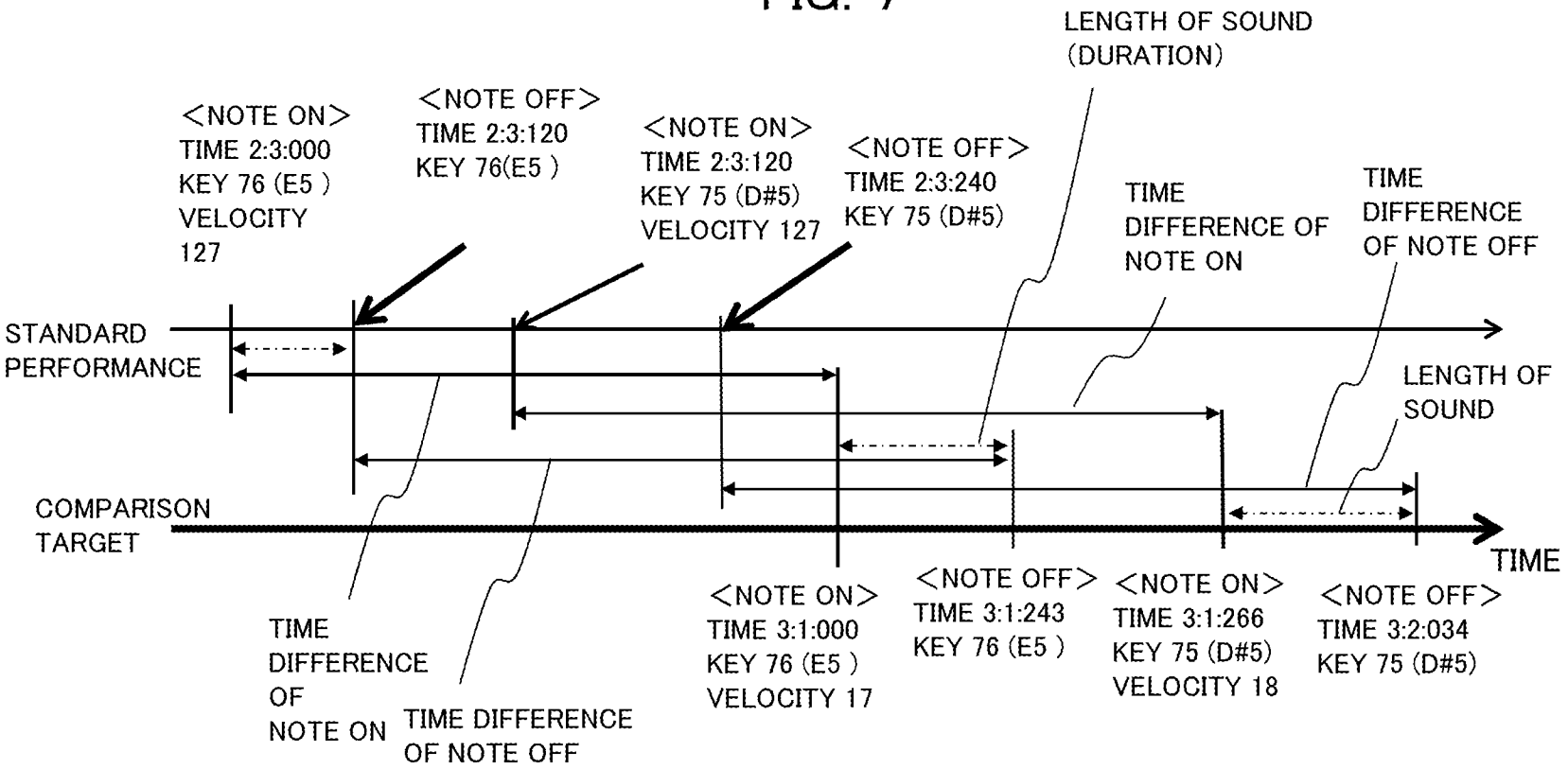
FIG. 7 is an illustrative view of musicality parameters.

FIG. 6 is a flowchart illustrating an example of the pre-processing. The pre-processing is performed by the processor 31. In S11, the processor 31 extracts event data from the comparison target MIDI file. In S12, the processor 31 extracts event data from the MIDI file of the standard performance. In S13, the processor 31 calculates time differences between events. FIG. 7 is an illustrative view of musicality parameters including time differences between events.

Note-ons and note-offs, as described above, are MIDI events. Note-ons and note-offs are stored as times (time stamps) from the start of the performance. The MIDI (the performance data) of the standard performance and the comparison target performance data are compared along an identical time axis. In MIDI, when a note-on event occurs, the generation timing of the note-on, the key type, and the strength (the velocity) with which the key is pressed are recorded as event data. Further, when a note-off event occurs, the generation timing of the note-off and the key type are recorded as event data.

At this time, the processor 31 records the time difference between the note-on timing of the standard performance and the note-on timing of the comparison target (the result of subtracting the note-on timing of the standard performance from the note-on timing of the comparison target; referred to as a note-on time difference or a note generation time difference) in relation to each of a plurality of note-ons included in the MIDI file of the standard performance as time differences between events. The processor 31 also records the velocities of the comparison target. Further, since a note-off inevitably follows a note-on, the processor 31 also records the time differences between the note-off timings of the standard performance and the note-off timings of the comparison target (referred to as note-off time differences or note release time differences) as time differences between events. Note, however, that recording the note release time differences is optional. The processor 31 also records the lengths of time between the note-ons and the note-offs, or in other words the durations, in relation to the comparison target performance data. Events are recorded in tick units. Note that the length of one tick is determined according to the time base and the tempo. The timing and strength (referred to as the hold) at which the pedal 7 is depressed are also recorded as events. The processor 31 records the durations of the comparison target performance data. Note that the duration corresponds to the length of a note generated by operating a performance controller.

The processor 31 performs the processing described above on all or a predetermined part of the comparison target performance data, creates a list of events arranged in time series order, and stores the list in the storage device 32 (S14). The event list includes, with respect to the comparison target performance data, the parameters included in the MIDI file, such as the note-ons, the note-offs, the velocities, and the holds, and recorded parameters calculated using the parameters in the MIDI file, such as the note-on time differences, the note-off time differences, and the durations.

In S15, the processor 31 selects the musicality parameters. Musicality is classified by determining, in a comprehensive fashion, the articulation, rhythm, phrasing, and dynamics, for example. Articulation is a way of dividing a melody or the like in a music playing method by adjusting the shapes of notes so as to add various contrasts and expressions to the joints between the notes. Articulation is often used in relation to shorter units than phrases. Phrasing means adding expression to music through the way in which phrases are separated from each other. Phrasing may also be expressed by slurring. Further, dynamics are a method of expressing music by varying and contrasting the strength of the notes.

In this embodiment, as described above, the processor 31 calculates a plurality of parameters, namely the note-on time differences, the note-off time differences, and the durations, using the plurality of parameters (i.e. the note-ons, the note-offs, and the velocities) acquired from the performance data (the MIDI file), and stores the plurality of calculated parameters in the storage device 32. The processor 31 then selects a combination of the note-on time differences, the velocities of the comparison target performance data, and the durations of the comparison target performance data from the plurality of calculated parameters as the musicality parameters. The processing then returns to S04, where the respective distances between the comparison target performance data (the first performance data) and the plurality of sets of performance data (the plurality of sets of second performance data) forming the distance matrix are calculated with respect to the selected musicality parameters. In other words, the respective distances (similarities) between the musicality parameters of the first performance data and the musicality parameters of the plurality of sets of second performance data are calculated. Here, musicality parameter data are data in which the note-on time differences and the corresponding velocities and durations of the comparison target performance data are stored in association with the respective note-on generation timings of the comparison target performance data, for example. The musicality parameter data include three elements, namely the note-on time differences and the velocities and durations of the comparison target, and may be treated as data that vary on a time axis (i.e. a function).

<Distance Matrix Generation>

Distance matrix generation, which is a prerequisite of the processing of S04, will now be described. The storage device 32 illustrated in FIG. 4 stores, as the plurality of sets of second performance data, a plurality of sets of performance data relating to the same composition as the composition of the first performance data, these data indicating the musicality parameters (the combination of the note-on time differences, the velocities, and the durations) of each of a plurality of sets of performance data that differ from the first performance data. The musicality parameters of each of the plurality of sets of second performance data are acquired by performing similar processing to the pre-processing described above (associatively storing the note-on time differences from the standard performance and the corresponding velocities and durations) using each of the plurality of sets of performance data as the comparison target.

A plurality of sets of second performance data generated by a plurality of performers are stored in relation to a single composition. Note, however, that the plurality of sets of second performance data may include two or more sets of performance data acquired from a plurality of performances (takes) played by the same performer. The second performance data may also include performance data generated by the same performer as the performer of the first performance data. The plurality of sets of second performance data may be collected from one or a plurality of terminal apparatuses 20, or may be provided as big data from any data source (a server device or the like) on the network 1. Each of the plurality of sets of second performance data is stored in association with information indicating the performer thereof.

Figure 8:
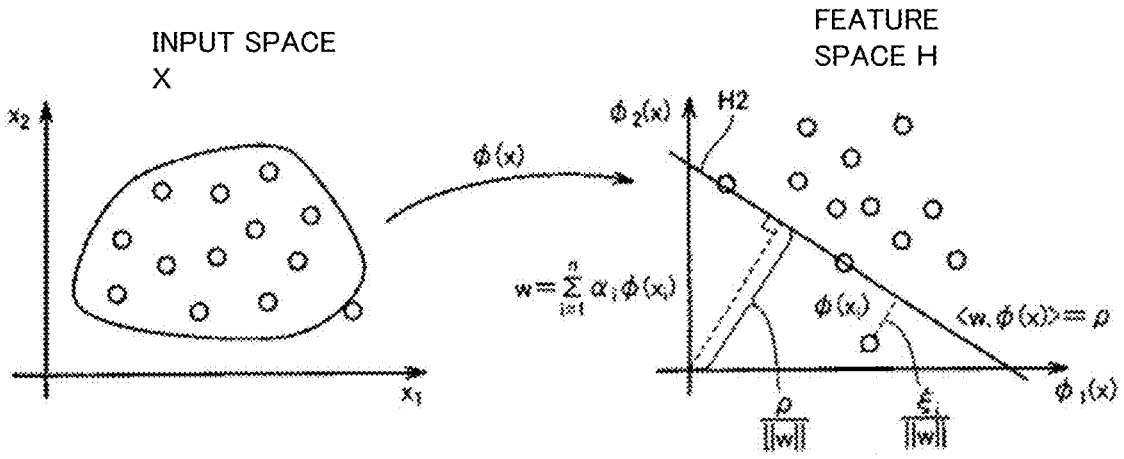
FIG. 8 is an illustrative view of a method for calculating distances between sets of performance data.

The plurality of sets of second performance data are output to a support vector machine (SVM). The SVM is realized by the processor 31 by executing an SVM program stored in the storage device 32. In a single class SVM, as illustrated in FIG. 8, the processor 31 uses a kernel trick to nonlinearly transform an input space X (the graph on the left side of FIG. 8) into a feature space H (the graph on the right side of FIG. 8), and determines the distance of each set of input performance data from an origin. The graph on the left side of FIG. 8 (the input space X) schematically illustrates an N-dimensional graph constituted by N factors in two dimensions. Each point on the graphs of FIG. 8 denotes a set of performance data (musicality parameter data). The performance data are data including three elements (vectors), namely the note-on time differences, the velocities, and the durations, which have been collected in an amount corresponding to the number of note-ons of the comparison target. Note that in the feature space H to which the input space X is transformed, a determination plane of the input space X becomes a nonlinear curved surface in an N-dimensional space.

Next, the distances between the sets of performance data in the feature space H are calculated. The distances to the other sets of performance data are calculated for each set of performance data. The distance calculation results are stored in the storage device 32 in the form of a matrix (a distance matrix).

More specifically, the processor 31 applies a single class SVM to each set of the second performance data to calculate the distance from the origin on the axis of the data space. Formula (1) illustrates a collection of performance data at a time point i (i=1, . . . , n). In formula (1), d denotes the number of measurement dimensions and indicates the number of types of data included in one set of performance data.

[Math. 1]

$$x_{u,i} \in R^d \tag{1}$$

Further, mapping from the input space X to the feature space H is represented by Φ (•). In a single class SVM, hyperplanes in the feature space H are estimated so as to separate larger amounts of performance data by greater distances from the origin. All of the hyperplanes in the feature space H are as described in formula (2). The hyperplanes are acquired by solving formula (3). In formula (3), $\xi_i$ is a slack variable. v is a positive parameter for adjusting the number of possible positions on the origin side.

[Math. 2]

$$\{x \in X \mid w, \varphi(x) - \rho = 0\} \ (\rho \geq 0) \tag{2}$$

$$\max_{w,\xi,\rho} -\frac{1}{2}\|w\|^2 - \frac{1}{\nu n}\sum_{i=1}^{n}\xi_i + \rho \tag{3}$$

$$\text{s.t. } < w, \phi(x_{u,i}) > \ \geq \rho - \xi_i \text{ and } \xi_i \geq 0 \ (i = 1, \ldots, n)$$

A kernel function is defined by formulae (4) and (5).

[Math. 3]

$$k: X \times X \rightarrow \mathbb{R} \tag{4}$$

$$k(x,x') = <\phi(x), \phi(x')> (k(x,x') \in H) \tag{5}$$

The dual of this problem is acquired as formula (6).

[Math. 4]

$$\min_{\alpha,\rho} \frac{1}{2}\sum_{i=1}^{n}\sum_{j=1}^{n}\alpha_i\alpha_j k(x_i, x_j) \tag{6}$$

$$\text{s.t. } 0 \leq \alpha_i \leq \frac{1}{\nu n} (i = 1, \ldots, n) \text{ and } \sum_{i=1}^{n}\alpha_i = 1$$

Optimization is solved using a quadratic programming solver, and the RBF Gaussian kernel shown below in formula (7) is applied as the kernel. In formula (7), σ>0, where σ is a kernel parameter (the kernel width).

[Math. 5]

$$k(x,x') = \exp(-\|x-x'\|^2/(2\sigma^2)) \tag{7}$$

Figure 9:
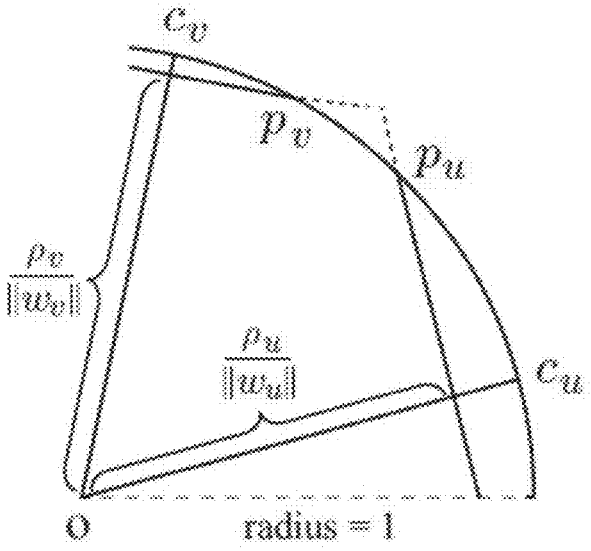
FIG. 9 is an illustrative view of the method for calculating distances between sets of performance data.

Next, calculation of the distances between single class SVM models of the performance data, which is used to calculate the distances between the sets of performance data, will be described. A distance (a similarity) $D_{uv}$ between two single class SVM models "($\alpha_u$, $\rho_u$)" and "($\alpha_v$, $\rho_v$)" relating to different performers is shown by formula (8). In formula (8), $c_u$, $c_v$, $p_u$, $p_v$ are respectively defined using a unit circle CR1 such as that illustrated in FIG. 9.

[Math. 6]

$$\mathcal{D}_{uv} = \frac{\widehat{c_u c_v}}{\widehat{c_u p_u} + \widehat{c_v p_v}} \tag{8}$$

The denominator of formula (8) is the sum of the length of an arc (an arc $C_uP_u$) between a point $C_u$ and a point $P_u$ on the unit circle CR1 and the length of an arc (an arc $C_vP_v$) between a point $C_v$ and a point $P_v$ on the unit circle CR1, and the numerator is the length of an arc (an arc $C_uC_v$) between the point $C_u$ and the point $C_v$. $w_u$ in FIG. 7 is defined by formula (9).

[Math. 7]

$$w_u = \Sigma_i \alpha_i \phi(x_{ui}) \tag{9}$$

$D_{uv}$ is a distance within a region/between regions affected by the Fisher ratio, as described in the documents "F. Desobry, M. Davy, and C. Doncarli, "An online kernel change detection algorithm," IEEE TRANSACTIONS ON SIGNAL PROCESSING, vol. 53, no. 8, pp. 2961-2974, 2005.", "P. S. Riegel, "Athletic records and human endurance," American Scientist May/June 81, vol. 69, no. 3, p. 285, 1981.", and so on.

The length of the arc $c_up_u$ in formula (8) indicates the scale of the variance among the samples (the performance data) in Φ(x) in the feature space H. When the variance of the samples increases, the length of the arc $c_up_u$ increases, leading to a reduction in a margin expressed by formula (10). The value of $D_{uv}$ is dependent on the expected behavior in the feature space H. In other words, the value of $D_{uv}$ increases as the spread of the samples increases and decreases as overlap increases.

[Math. 8]

$$\rho_u / \|w_u\| \tag{10}$$

$D_{uv}$ is expressed by the unit circle and the length of an arc ab between two vectors a and b. The length of the arc formed by the vector a and the vector b is equivalent to an angle formed by the vector a and the vector b, and with respect to the vector a and the vector b, formula (11) is established, whereupon the length of the arc ab is determined by formula (12). Accordingly, $c_u$ is determined as shown in formula (13), and $c_v$ is determined as shown in formula (14). Using $c_u$ and $c_v$, the length of the arc of $c_u c_v$ is derived using formula (15).

[Math. 9]

$$<a, b> = \|a\|\|b\|\cos(\angle(a, b)) = \cos(\angle(a, b)) \tag{11}$$

$$\widehat{ab} = \arccos(<a, b>) \tag{12}$$

$$c_u = w_u/\|w_u\| \tag{13}$$

$$c_v = w_v/\|w_v\| \tag{14}$$

$$\widehat{c_u c_v} = \arccos\left(\frac{< w_u, w_v >}{\|w_u\|\|w_v\|}\right) = \arccos\left(\frac{\alpha_u^T K_{uv} \alpha_v}{\sqrt{\alpha_u^T K_{uu} \alpha_u}\sqrt{\alpha_v^T K_{vv} \alpha_v}}\right) \tag{15}$$

Here, $K_{uv}$ in formula (15) is a kernel matrix. The kernel matrix is expressed by elements k ($x_{u,i}$, $x_{u,j}$) in relation to columns i and rows j. Further, the length of the arc $c_u p_u$ is expressed as shown below in formula (16).

[Math. 10]

$$\widehat{c_u p_u} = \arccos\left(\frac{\rho_u}{\sqrt{\alpha_u^T K_{uu} \alpha_u}}\right) \tag{16}$$

As described above, the distance of each set of performance data from the origin is calculated by calculating a single class SVM model. The distances between all of the sets of performance data are then determined from the distance of each set of performance data from the origin.

Figures 10, 11:
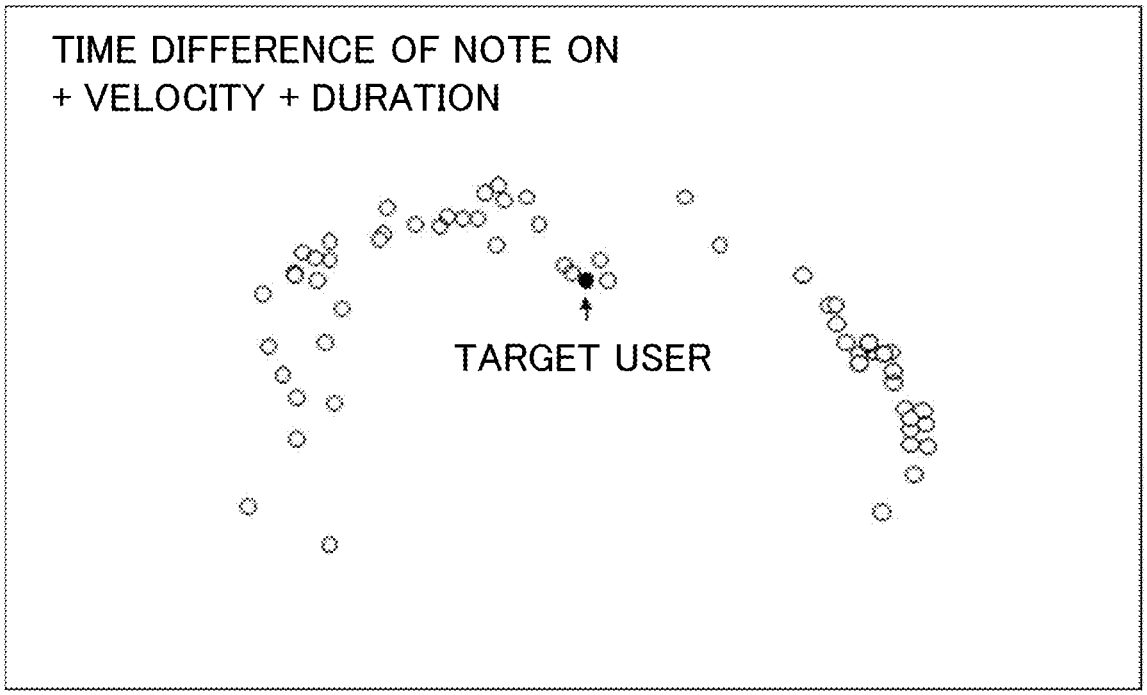
FIG. 10 illustrates an example of a distance matrix.
FIG. 11 illustrates an example of a graph visualized by multidimensional scaling.

FIG. 10 illustrates an example of a distance matrix. The processor 31 of the server 30 roundly calculates distances for the musicality parameters in relation to the plurality of sets of second performance data stored in the storage device 32. The processor 31 then stores the calculated distances in the storage device 32 in the form of a matrix (a distance matrix). On the distance matrix, roundly calculated distances are stored in matrix form for a plurality of sets of performance data, which are constituted by five sets of performance data d(1) to d(5) in the example of FIG. 10. On the distance matrix, the distance between identical sets of performance data is set at "0", and therefore values on a diagonal line extending from the upper left corner to the lower right corner of the matrix are set at "0". The matrix of d(2) illustrates the distance between d(2) and d(1), while the matrix of d(3) illustrates the respective distances of d(3) from d(1) and d(2). The matrix of d(4) illustrates the respective distances of d(4) from d(1) to d(3). The matrix of d(5) illustrates the respective distances of d(5) from d(1) to d(4).

In the processing of S04, the processor 31 uses the distance calculation method described above to calculate the respective distances between the first performance data and the plurality of sets of second performance data with respect to the musicality parameters described above. The processor 31 also reads the distance matrix from the storage device 32 and updates the distance matrix by adding a matrix indicating the respective distances between the first performance data and the plurality of sets of second performance data (S05).

In S06, the processor 31 generates data of a graph on which a distribution of the distances between the first performance data and the plurality of sets of second performance data with respect to the musicality parameters are visualized by multidimensional scaling (MDS), and outputs/displays the generated data from the output device 36.

FIG. 11 illustrates an example of a graph visualized by multidimensional scaling. A point indicating the first performance data is disposed substantially in the center of the screen as a point of a "target user", and points respectively indicating the sets of the second performance data ae distributed at distances from the first performance data. Although not illustrated in FIG. 11, performance identification information such as the names of the performers may be displayed near the points indicating the performance data. A person viewing this performance data distribution may intuitively classify the performers into a plurality of musicality groups.

In S07, the processor 31 generates ranking information ranking the plurality of sets of second performance data that have been compared with the comparison target performance data, i.e. the first performance data, in ascending or descending order of distance and outputs the generated ranking information from the output device 36.

FIG. 12A and FIG. 12B illustrate an example of the ranking information. The name of the performer (the identification information of the performer), a performance identification number (identification information of the performance), and the name of the composition are stored associatively in the performance data. For each set of second performance data that has been compared with the first performance data, the performer name, the performance identification number, and the distance to the first performance data with respect to the musicality parameters are displayed.

In the example of FIG. 12A and FIG. 12B, the top 30 rankings are displayed in a table format in ascending order of distance. The performer of the first performance data is "Ana", and the performer in first place in the rankings is the same performer, i.e. "Ana". Thus, when the performer is the same person, the distance decreases (the similarity increases). When rankings are displayed in this manner, a person viewing the rankings may likewise intuitively classify the performers into a plurality of musicality groups.

Note that the order of S06 and S07 may be reversed. Alternatively, only one of S06 and S07 may be executed. Further, the first performance data, by being incorporated into the distance matrix, become one of the plurality of sets of second performance data. Using the input device 35 or by remote control, for example, a comparison target (a central) set of performance data may be specified from among the plurality of sets of second performance data. When a set of performance data is specified, ranking information is generated with the specified performance data set as the comparison target performer. When the composition is the same, the performance data are specified by inputting or specifying the performer or a performance trial number. The ranking information is generated by the processor 31 by, for example, setting a specified set of performance data, from either the row or the column of the performance data (the performance data that was previously the first performance data) last added to the distance matrix, as the comparison target performance data, and rearranging the data in ascending or descending order of distance.

The second performance data and the distance matrix may be stored in the storage device 32 for two or more compositions, and distances may be calculated for each of the two or more compositions and then displayed as a distribution or rankings. Moreover, the plurality of sets of performance data may be classified into a plurality of musicality groups automatically or mechanically using a given classification algorithm such as k-means.

Composition Data Editing

A person (an operator of the server 30 or the like) viewing the graph or the ranking table illustrating the distribution of the performance data may classify the first and second performance data (the performers) into two or more musicality groups. Each set of performance data is stored in the storage device 32 in association with information indicating the group to which the performance data belongs. Further, the storage device 32 stores a database of a plurality of compositions. Performance data (MIDI files) for the plurality of compositions and information indicating the musicality group to which each set of performance data belongs are stored in an associative state in the composition database.

Figure 13:
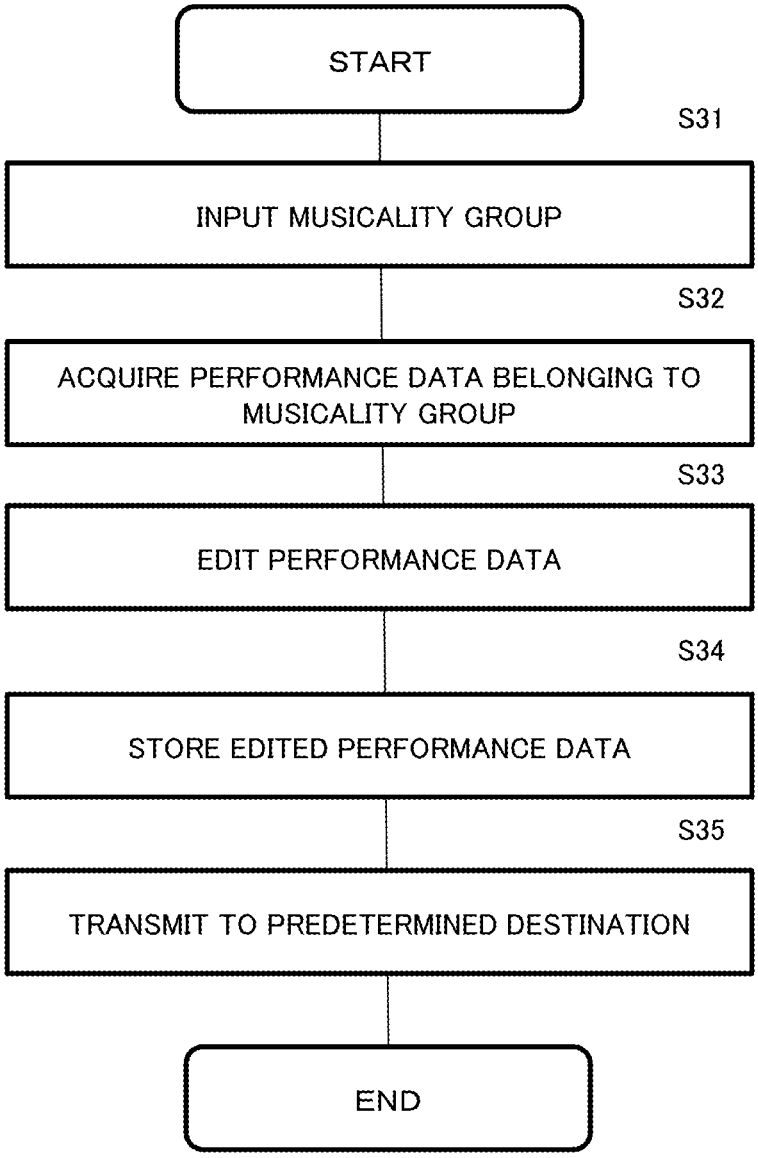
FIG. 13 is a flowchart illustrating an example of composition data editing processing.

FIG. 13 is a flowchart illustrating an example of processing for editing the composition data. In S31, information specifying a musicality group is input by being input into the server 30 from the input device 35 or received from the network 1. In response, the processor 31 acquires the one or two or more sets of performance data associated with the specified musicality group from the storage device 32 (S32). As regards the acquired performance data, as long as one or two or more sets of performance data are acquired, the number of acquired compositions and the number of acquired sets of performance data may be set as appropriate.

In S33, the processor 31 edits the performance data of one or two or more compositions on the basis of a predetermined editing rule. For example, the processor 31 generates edited performance data by extracting partial data from each of the one or two or more sets of performance data and joining the partial data. There are no particular limitations on the manner in which the partial data are extracted, and the partial data may be extracted using any method, such as extracting the data of a predetermined number of measures from the start of the performance, extracting the data of one chorus or the so-called hook part, or extracting the data of a predetermined period of time from the start of the performance. The performance data of two or more compositions may also be joined as is, without extracting partial data therefrom. The joined parts may be provided with a silent interval, even when the compositions overlap.

In S34, the processor 31 stores a MIDI file of the edited performance data generated in S33 in the storage device 32. In S35, if a predetermined transmission destination for the edited performance data, a transmission destination specified together with the musicality group, a preset transmission destination, or the like exists, the processor 31 transmits the MIDI file of the edited performance data to the transmission destination. The transmission destination is the terminal apparatus 20 that transmitted a provision request for the edited performance data, for example. Note, however, that the edited performance data may be transmitted to a device other than the terminal apparatus 20.

The terminal apparatus 20, upon reception of the edited performance data, stores the data in the storage device 22, and may then output the reproduced sound of the edited performance data using a playback application (a MIDI player) executed by the processor 21. Alternatively, the edited performance data may be transferred to the electronic piano 10, and the electronic piano 10 may execute an automatic performance using the edited performance data. Note that in S34, the performance data acquired in S32 may be transmitted to the predetermined transmission destination as is instead of the edited performance data.

Note that in response to the output of a distance calculation result in relation to the comparison target performance data (the first performance data), the musicality group to which the first performance data belongs may be specified, compositions belonging to the musicality group may be searched for in the composition database, and a search result list may be created and stored in association with the performer of the first performance data.

Effects of the Embodiments

According to the first embodiment, information indicating the distances between sets of performance data is output with respect to the musicality parameters and used to classify the performance data into musicality groups. Thus, it is possible to present and classify musicality, which is a subjective evaluation, in an objective fashion. For example, by using the performance data of a predetermined performer (a well-known performer, a competition winner, or the like) as the first performance data and calculating the distances from the first performance data to a plurality of sets of second performance data, it is possible to identify a group of performers having a musicality that is close to that of the predetermined performer.

Further, the display of the rankings or the distribution may be used as information enabling performers having a similar musicality to communicate with each other or to form a community. Moreover, by enabling specification of the musicality group to which a performer belongs, edited composition data may be generated for a composition belonging to the group, and the data may be provided to the terminal apparatus 20 of the performer. The person who receives the provided data may then listen to a composition performed with the same (preferred) musicality. Alternatively, the edited composition data of a composition belonging to a certain musicality group may be transmitted to the terminal apparatus 20 and performed automatically by the electronic piano 10 or the like, whereby a preferred musical performance may be played at a gathering of people who belong to the musicality group or the like.

In the first embodiment described above, a combination of the note-on time differences, the velocities of the comparison target performance data (the first performance data), and the durations of the comparison target performance data (the first performance data) was cited as an example of the musicality parameters. However, parameters other than those cited in this embodiment may be selected as appropriate as the parameters that are combined with the note-on time differences. For example, in the pre-processing described above, differences (referred to as velocity differences) between the velocities of the standard performance and the velocities of the comparison target performance data or differences (referred to as duration differences) between the durations of the standard performance and the durations of the comparison target performance data may be calculated and used as elements of the musicality parameters. In other words, a combination of the note-on time differences, the velocity differences, and the duration differences may be used as the musicality parameters. To put it another way, at least one element among the velocities of the comparison target, the durations of the comparison target, the velocity differences, and the duration differences may be selected as the parameter that is combined with the note-on time differences. Alternatively, either the velocities of the comparison target or the velocity differences may be selected in relation to the velocity and either the durations of the comparison target or the duration differences may be selected in relation to the duration, and the selected elements may be combined with the note-on time differences.

Further, in the pre-processing of the first embodiment, the note-on time differences and the velocities and durations of the comparison target performance data are recorded as the musicality parameters. During this pre-processing, the processor 31 may determine whether or not a note-on of the comparison target performance data is a mistouch. The mistouch determination method may be selected as appropriate, for example by determining a mistouch when the key type differs from the key type of the standard performance. When the processor 31 determines that a note-on is a mistouch (relative to, for example, the key of the standard performance), the processor 31 skips calculation of the note-on time difference and the duration relating to the note-on and excludes the note-on from the data used for distance calculation. As a result, mistouches may be excluded from the information used to determine and classify the musicality.

Second Embodiment

Next, a second embodiment will be described. The configuration of the second embodiment has points in common with the configuration of the first embodiment, and therefore differences therebetween will mainly be described, while description of these shared points has been omitted. The configurations of the electronic piano 10, the terminal apparatus 20, and the server 30 described in the first embodiment may also be applied to the second embodiment. The processing performed by the server 30, however, is different.

Figure 14:
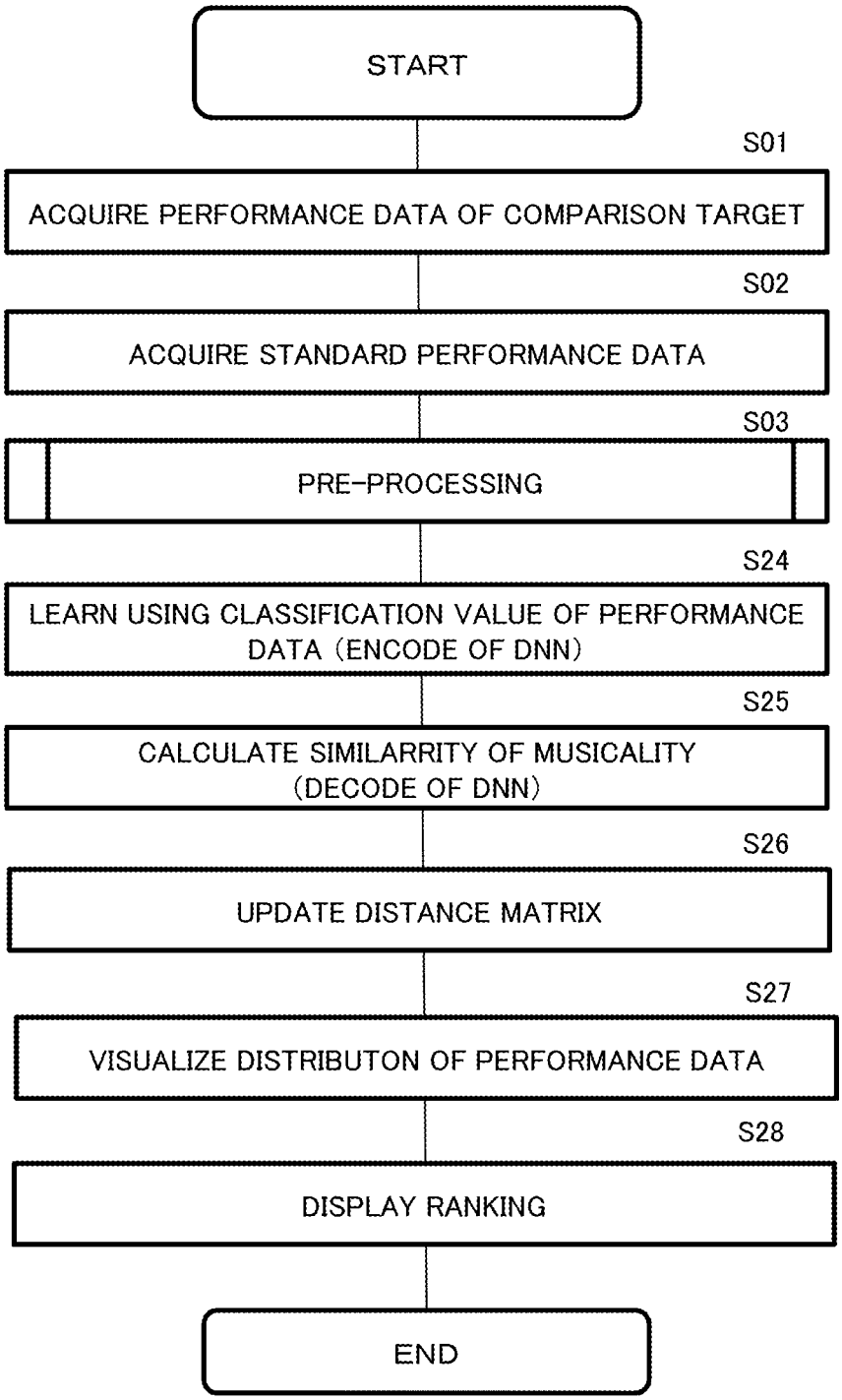
FIG. 14 is a flowchart illustrating an example of processing executed by a processor of a server according to a second embodiment.

FIG. 14 is a flowchart illustrating an example of the processing executed by the processor 31 of the server 30 according to the second embodiment. In the second embodiment, the processing of S01 to S03 is identical to the first embodiment, and therefore description thereof has been omitted.

In S24, the processor 31 performs learning using classification values of the performance data. More specifically, the processor 31 uses several sets of the second performance data as a learning sample and assigns identification numbers (trial numbers) thereto. Further, in relation to the sample, the processor 31 calculates the distances between the sets of performance data with respect to the musicality parameters, as described in the first embodiment, and sets an identical classification value in sets of performance data that are considered, in accordance with the distance calculation results, to be close in terms of musicality. Thus, the processor 31 defines a classification value for each performance of the sample. Then, in accordance with the classification values, the processor 31 learns (performs a deep neural network (DNN) weight calculation on) a classification pattern of the performance data. As a result of the learning, the processor 31 generates a weighting matrix for classifying the musicality, and stores the generated matrix in the storage device 32. The processing of S24 may be executed either before or in parallel with S01 to S03.

In S25, the processor 31 calculates the similarities of the musicality with respect to the comparison target performance data. More specifically, the processor 31 acquires a classification value relating to the comparison target performance data (the first performance data) using the comparison target performance data relating to the musicality parameters acquired in the pre-processing and the weighting matrix acquired by learning in S24.

In S26, the processor 31 updates the distance matrix. FIGS. 15 and 16 are illustrative views illustrating generation and updating of the distance matrix. FIG. 15 illustrates an example of a list on which trial numbers 1 to 5 are assigned to 5 learning samples, and "1", "2", "1", "5", and "5" are defined as the classification values of the samples having the trial numbers 1 to 5. In this case, the processor 31 creates a matrix on which the trial number is set as the row number and the column number, and the classification value of the trial number of a target row number is the absolute value of the difference from the other classification value. For example, the value of row 5, column 1 is "4", which is the absolute value of the difference between the classification value "1" of the trial number 1 and the classification value "5" of the trial number 5, and the value of row 5, column 2 is "3", which is the absolute value of the difference between the classification value "2" of the trial number 2 and the classification value "5" of the trial number 5. Further, the value of row 5, column 3 is "4", which is the absolute value of the difference between the classification value "1" of the trial number 3 and the classification value "5" of the trial number 5, and the value of row 5, column 4 is "0", which is the difference between the classification value "5" of the trial number 4 and the classification value "5" of the trial number 5. This diagonal matrix is generated as the distance matrix and stored in the storage device 32.

It is assumed that when the similarities are calculated using the weighting matrix in S25, a classification value of "3.3" is calculated for the comparison target performance data. In this case, as illustrated in FIG. 16, the next trial number "6" assigned to the comparison target performance data and the classification value "3.3" thereof are added to the list. Further, row 6 and column 6, corresponding to the trial number 6, are added to the distance matrix, and the absolute values of the differences between the classification value "3.3" of the trial number 6 and the classification values of the trial numbers 1 to 5 are set as the values in the respective columns of the sixth row and the values in the respective rows of the sixth column as the distances between the sets of performance data. Thus, the distance matrix is updated.

In S27, visualization of the distribution of the performance data, or in other words similar processing to the processing of S06, is performed. For example, on the distance matrix illustrated in FIG. 16, the differences indicated by the classification values on the sixth row or the sixth column are treated as the respective distances between the performance data having the trial number 6 and the sets of performance data having the trial numbers 1 to 5, and a graph showing the respective sets of performance data and the distances thereof as a point distribution is output.

In S28, ranking information is generated and output. The processing of S28 is similar to the processing of S07. For example, on the distance matrix illustrated in FIG. 16, the differences indicated by the classification values on the sixth row or the sixth column are set as the ranking targets, the performance data having the trial number 6 is set as the comparison target, and ranking information ranking the classification values (distances) in ascending or descending order is generated and output by the output device 36.

As illustrated by the second embodiment, distance calculation may be performed by deep learning as well as the method using an SVM, described in the first embodiment. The configurations described in the first and second embodiments may be combined as appropriate within a scope that does not depart from the object of the present invention.

What is claimed is:

1. A musicality information provision method, comprising:

acquiring, using a processor, first performance data from a performance of a given composition;

calculating, using the processor, with respect to a combination of a plurality of parameters indicating musicality, which are included in the first performance data, respective distances between the first performance data and a plurality of sets of second performance data that are acquired from performances of the given composition and that are compared with the first performance data, wherein the plurality of parameters indicating the musicality include time differences between operation start timings of performance controllers during a standard performance of the given composition and operation start timings of the performance controllers in the first performance data; and outputting, using the processor, determination information for determining the musicality of the first performance data, the determination information including information indicating the respective distances.

2. The musicality information provision method according to claim 1, wherein the combination of the plurality of parameters indicating the musicality is a combination of the time differences between the operation start timings of the performance controllers during the standard performance of the given composition and the operation start timings of the performance controllers in the first performance data, differences between strengths by which the performance controllers are operated during the standard performance and the strengths by which the performance controllers are operated in the first performance data, and differences between lengths of notes produced by operating the performance controllers during the standard performance and the lengths of the notes produced by operating the performance controllers in the first performance data.

3. The musicality information provision method according to claim 1, wherein the combination of the plurality of parameters indicating the musicality is a combination of the time differences between the operation start timings of the performance controllers during the standard performance of the given composition and the operation start timings of the performance controllers in the first performance data, strengths by which the performance controllers are operated in the first performance data, and lengths of notes produced by operating the performance controllers in the first performance data.

4. The musicality information provision method according to claim 1, wherein the information indicating the respective distances includes information indicating a distribution of the first performance data and the plurality of sets of second performance data with respect to the plurality of parameters indicating the musicality.

5. The musicality information provision method according to claim 1, wherein the information indicating the respective distances includes information indicating sets of second performance data, among the plurality of sets of second performance data, up to a predetermined ranking in ascending or descending order of a corresponding distance of the respective distances from the first performance data.

6. The musicality information provision method according to claim 1, wherein the information indicating the respective distances includes information indicating respective performers of the first performance data and the second performance data.

7. The musicality information provision method according to claim 1, further comprising:

determining, using the processor, a musicality group to which the first performance data belongs based on the information indicating the respective distances;

acquiring, using the processor, one or more sets of performance data that are different from the first performance data but belong to the determined musicality group; and generating, using the processor, edited performance data by editing the one or more sets of performance data.

8. The musicality information provision method according to claim 7, further comprising transmitting, using by the processor, the edited performance data to a predetermined transmission destination.

9. A musicality information provision apparatus, comprising:

a memory; and a processor configured to:

acquire first performance data from a performance of a given composition;

calculate, with respect to a combination of a plurality of parameters indicating musicality, which are included in the first performance data, respective distances between the first performance data and a plurality of sets of second performance data that are acquired from performances of the given composition and that are compared with the first performance data, wherein the plurality of parameters indicating the musicality include time differences between operation start timings of performance controllers during a standard performance of the given composition and operation start timings of the performance controllers in the first performance data; and output determination information for determining the musicality of the first performance data, the determination information including information indicating the respective distances.

10. A musicality information provision system, comprising:

a terminal apparatus configured to transmit performance data of a given composition performed using an electronic musical instrument; and a server including:

a receiver configured to receive the performance data as first performance data; and a processor configured to:

calculate, with respect to a combination of a plurality of parameters indicating musicality, which are included in the first performance data, respective distances between the first performance data and a plurality of sets of second performance data that are acquired from performances of the given composition and that are compared with the first performance data, wherein the plurality of parameters indicating the musicality include time differences between operation start timings of performance controllers during a standard performance of the given composition and operation start timings of the performance controllers in the first performance data; and output determination information for determining the musicality of the first performance data, the determination information including information indicating the respective distances.

* * * * *